US011742624B2

(12) United States Patent
Kameyama et al.

(10) Patent No.: US 11,742,624 B2
(45) Date of Patent: Aug. 29, 2023

(54) HIGH-FREQUENCY COAXIAL ELECTRICAL CONNECTOR WITH SHIELDS COVERING CABLE CONDUCTORS AND TERMINALS

(71) Applicant: Yazaki Corporation, Tokyo (JP)

(72) Inventors: Isao Kameyama, Makinohara (JP); Michikazu Aono, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/508,104

(22) Filed: Oct. 22, 2021

(65) Prior Publication Data

US 2022/0131322 A1 Apr. 28, 2022

(30) Foreign Application Priority Data

Oct. 23, 2020 (JP) ..... 2020-178179
Dec. 23, 2020 (JP) ..... 2020-214021

(51) Int. Cl.
*H01R 24/40* (2011.01)
*H01R 9/05* (2006.01)
(Continued)

(52) U.S. Cl.
CPC ..... *H01R 24/40* (2013.01); *H01R 9/0518* (2013.01); *H01R 13/6582* (2013.01);
(Continued)

(58) Field of Classification Search
CPC .. H01R 24/40; H01R 9/0518; H01R 13/6582; H01R 13/6592; H01R 9/03; H01R 9/05;
(Continued)

(56) References Cited

U.S. PATENT DOCUMENTS 5,123,864 A * 6/1992 Karlovich ..... H01R 9/0518 439/585
2019/0305445 A1 10/2019 Yamaguchi
2020/0127421 A1* 4/2020 Jones ..... H01R 4/188

FOREIGN PATENT DOCUMENTS

EP 0 313 186 A2 4/1989
EP 313186 A * 4/1989 ..... H01R 24/40
(Continued)

*Primary Examiner* — Abdullah A Riyami
*Assistant Examiner* — Justin M Kratt
(74) *Attorney, Agent, or Firm* — Sughrue Mion, PLLC

(57) ABSTRACT

A female high-frequency connector includes a female inner terminal connected to a core wire of a cable in which an outer periphery of an insulator covering the core wire is covered with a braid, a female inner housing accommodating the female inner terminal in an inner terminal accommodating chamber, a tubular female shield body covering an outer periphery of the female inner housing, a female crimping member having a braid crimping piece that is crimped from above the braid, and a tubular female shield sleeve having a tubular braid covered portion that is inserted between the insulator and the braid and having a fitting portion that extends from the braid covered portion and is inserted between the outer periphery of the female inner housing and an inner periphery of the female shield body to cover a gap between the braid crimping piece and the female shield body.

6 Claims, 11 Drawing Sheets

(51) Int. Cl.

| | |
|---|---|
| ***H01R 13/6582*** | (2011.01) |
| ***H01R 13/6592*** | (2011.01) |
| *H01R 24/38* | (2011.01) |
| *H01R 9/03* | (2006.01) |
| *H01R 13/648* | (2006.01) |
| *H01R 13/6593* | (2011.01) |
| *H01R 13/658* | (2011.01) |
| *H01R 103/00* | (2006.01) |

(52) U.S. Cl.
CPC ..... *H01R 13/6592* (2013.01); *H01R 9/03* (2013.01); *H01R 9/05* (2013.01); *H01R 13/648* (2013.01); *H01R 13/658* (2013.01); *H01R 13/6593* (2013.01); *H01R 24/38* (2013.01); *H01R 2103/00* (2013.01)

(58) Field of Classification Search
CPC ..... H01R 13/648; H01R 13/658; H01R 13/6593; H01R 24/38; H01R 2103/00
See application file for complete search history.

(56) References Cited

FOREIGN PATENT DOCUMENTS

| | | | | |
|---|---|---|---|---|
| EP | 0313186 | A2 | * | 4/1989 |
| JP | 47-33279 | A | | 11/1972 |
| JP | 1-130485 | A | | 5/1989 |
| JP | 6-68938 | A | | 3/1994 |
| JP | 2000-156261 | A | | 6/2000 |
| JP | 2000156261 | A | * | 6/2000 |
| JP | 2003-317882 | A | | 11/2003 |
| JP | 2019-185858 | A | | 10/2019 |

* cited by examiner

HIGH-FREQUENCY COAXIAL ELECTRICAL CONNECTOR WITH SHIELDS COVERING CABLE CONDUCTORS AND TERMINALS

CROSS-REFERENCE TO RELATED APPLICATIONS

This application is based on and claims priority under 35 USC 119 from Japanese Patent Applications No. 2020-178179 filed on Oct. 23, 2020 and No. 2020-214021 filed on Dec. 23, 2020, the contents of which are incorporated herein by reference.

TECHNICAL FIELD

The present invention relates to a high-frequency connector.

BACKGROUND ART

As a frequency of an electric signal transmitted using a shielded electric wire (cable) increases, a demand for improving a high frequency characteristic of a high-frequency connector connected to this cable also increases.

For example, in a coaxial connector (high-frequency connector) disclosed in Patent Literature 1, an inner conductor terminal (inner terminal) accommodated in a dielectric (inner housing) integrated with a metal body is connected to a signal conductor (core wire) of a coaxial cable (cable) at an end of the coaxial cable. An outer conductor terminal accommodating the dielectric integrated with the metal body is connected to a shield conductor (braid) of the coaxial cable. An insulator of the coaxial cable is inserted into the metal body. The shield conductor is disposed on an outer periphery of the metal body, and a braid crimping piece of the outer conductor terminal is crimped together with the shield conductor. An outer skin crimping piece of the outer conductor terminal is crimped to a sheath of the coaxial cable.

A connector (high-frequency connector) disclosed in Patent Literature 2 includes an L-shaped coaxial terminal having an external terminal provided outside an internal terminal, a shield member that shields the coaxial terminal, and a housing provided with an L-shaped terminal accommodating portion that accommodates the coaxial terminal and the shield member inside. The shield member can enhance a shielding effect of the connector by covering a gap formed inside an L-shaped bent portion of the coaxial terminal.

CITATION LIST

Patent Literature

Patent Literature 1: JP-2003-317882-A
Patent Literature 2: JP-2019-185858-A

SUMMARY OF INVENTION

However, in a connection structure of the outer conductor terminal connected to the end of the coaxial cable in the related art, as shown in FIG. 4 of Patent Literature 1 (or FIG. 7 of Patent Literature 2), a gap corresponding to a connecting portion connecting a body tube portion and the braid crimping piece occurs between a rear edge of the body tube portion of the outer conductor terminal (support portion of the external terminal) and a front edge of the braid crimping piece of the outer conductor terminal (outer conductor barrel) crimped to the shield conductor in an axial direction. This gap may reduce a noise shielding performance between the coaxial cable and the outer conductor terminal. A current flows through the body tube portion, the connecting portion, the braid crimping piece, and the shield conductor forming a shield circuit, and a magnetic field is generated. At the same time, a return current flows and a magnetic field is generated in an opposite direction. As a result, the magnetic field due to the current and the magnetic field in the opposite direction due to the return current cancel each other out, but the connecting portion exists only on a lower side in an up-down direction (not a complete circumference in a cross section). Therefore, the return current flows unevenly (concentrated) to the connecting portion existing only on the lower side, and the current in the axial direction is biased. Due to this bias, there is a concern that a transmission performance may be reduced between the coaxial cable and the outer conductor terminal. As a result, there is a concern that a communication performance in a communication circuit may be reduced due to a reduction in the noise shielding performance and a reduction in the transmission performance.

The present invention has been made in view of the above circumstances, and an object of the present invention is to provide a high-frequency connector in which a communication performance is improved by preventing a reduction in a noise shielding performance and a reduction in a transmission performance.

The object of the present invention is achieved with the following configuration.

A high-frequency connector includes: an inner terminal connected to a core wire of a cable in which an outer periphery of an insulator covering the core wire is covered with a braid; an inner housing accommodating the inner terminal in an inner terminal accommodating chamber; a tubular shield body covering an outer periphery of the inner housing; a crimping member having a braid crimping piece that is crimped from above the braid; and a tubular shield sleeve having a tubular braid covered portion that is inserted between the insulator and the braid and having a fitting portion that extends from the braid covered portion and is inserted between the outer periphery of the inner housing and an inner periphery of the shield body to cover a gap between the braid crimping piece and the shield body.

The present invention has been briefly described as above. Further, details of the present invention will be clarified by reading a mode (hereinafter, referred to as an "embodiment") for carrying out the invention to be described below with reference to the accompanying drawings.

DESCRIPTION OF EMBODIMENTS

Hereinafter, embodiments according to the present invention will be described with reference to the drawings.

Figure 1A:
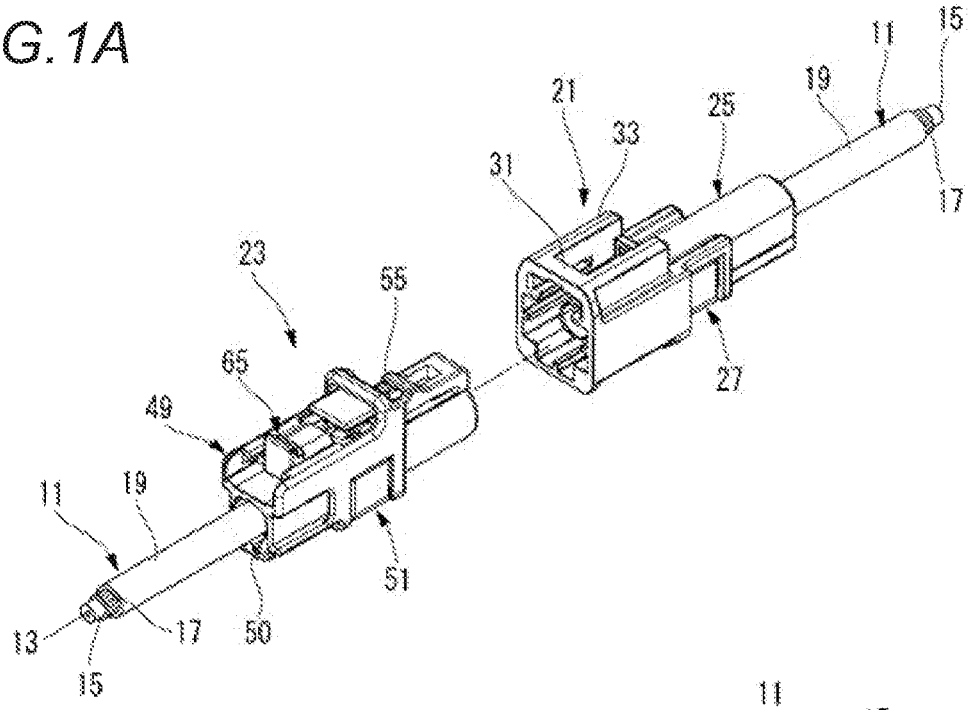
FIG. 1A is a perspective view before fitting of a male high-frequency connector and a female high-frequency connector according to an embodiment of the present invention.
Figure 1B:
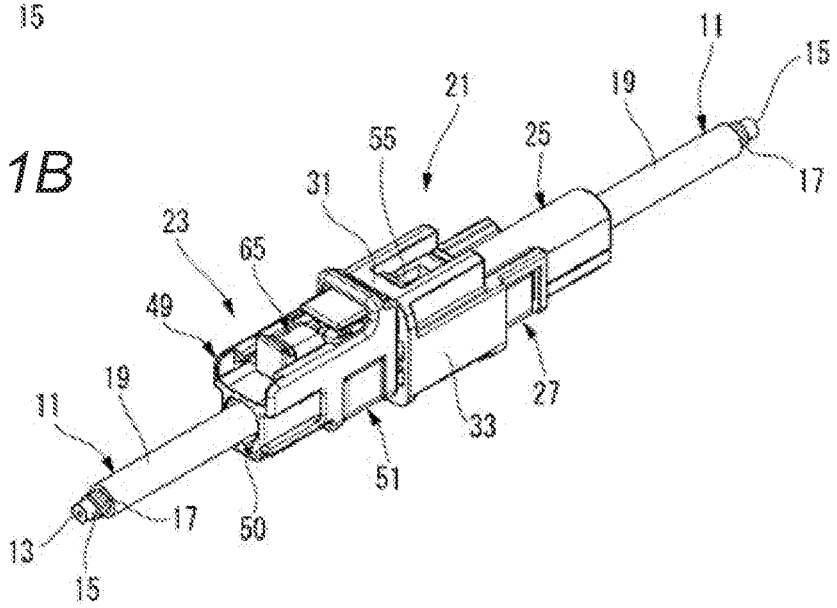
FIG. 1B is a perspective view after the fitting in FIG. 1A.

FIG. 1A is a perspective view before fitting of a male high-frequency connector 21 and a female high-frequency connector 23 according to an embodiment of the present invention, and FIG. 1B is a perspective view after the fitting in FIG. 1A.

The high-frequency connector according to the present embodiment is attached to an end of a cable 11 and used as a cable with a high-frequency connector. As the cable 11, for example, a coaxial cable is used.

In a description of the male high-frequency connector 21 and the female high-frequency connector 23, the same component members are denoted by the same reference signs.

[Coaxial Cable]

Figure 3:
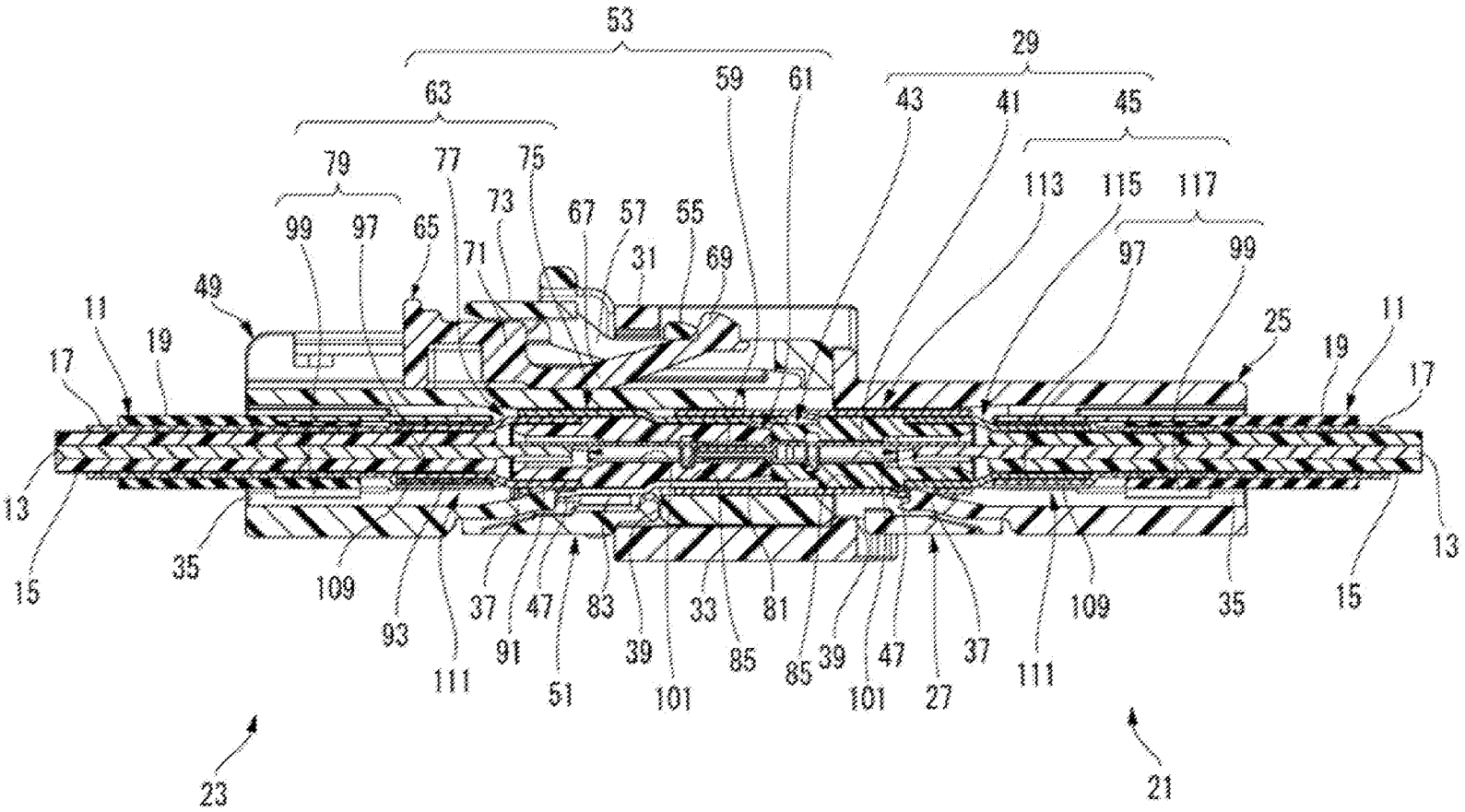
FIG. 3 is a cross-sectional view of the fitted female high-frequency connector and the male high-frequency connector in a direction along a core wire.
Figure 4:
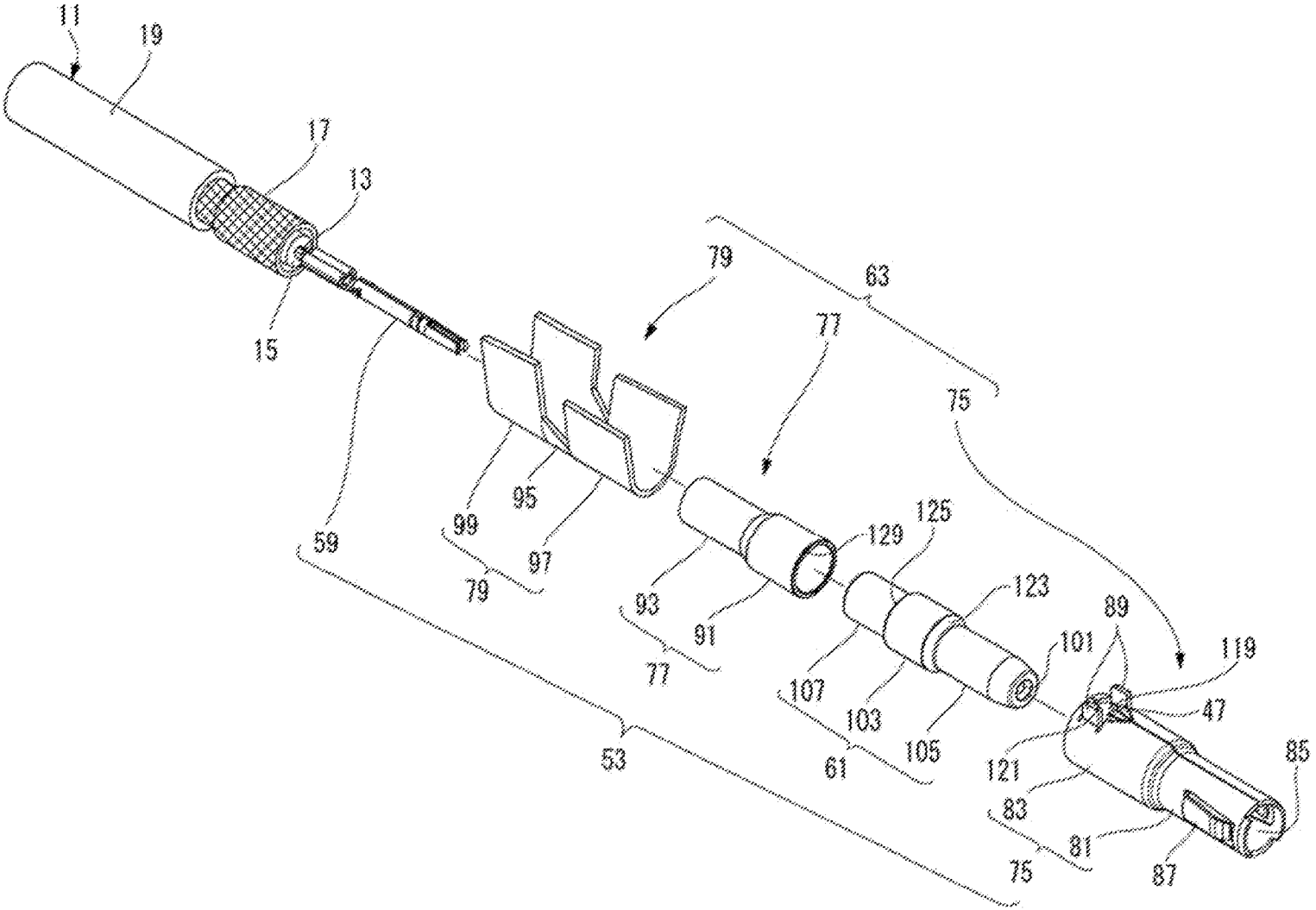
FIG. 4 is an exploded perspective view of a female shield assembly shown in FIG. 2A.

The cable 11 includes, from a center side, a core wire 13, an insulator 15, a braid 17, and a sheath 19 (see FIGS. 3 and 4). The core wire 13 having conductivity may be either a single wire or a twisted wire obtained by twisting a plurality of wires. The insulator 15 has electrical insulation property and covers the core wire 13. The braid 17 has the conductivity and covers an outer periphery of the insulator 15. The sheath 19 has the electrical insulation property and covers an outer periphery of the braid 17.

In the present embodiment, the cable 11 is a coaxial cable having the braid 17, but other configurations are not limited as long as the cable has the braid 17.

As shown in FIGS. 1A and 1B, the high-frequency connector connected to the cable 11 is divided into the male high-frequency connector 21 and the female high-frequency connector 23. The high-frequency connector according to the present embodiment can be used for both the male high-frequency connector 21 and the female high-frequency connector 23. Main parts of a configuration according to the present invention are substantially the same for the male high-frequency connector 21 and the female high-frequency connector 23. In a following description, the main parts of the configuration according to the present invention will be described mainly with the female high-frequency connector 23 as a representative example. First, an outline of the male high-frequency connector 21 will be described.

[Male High-Frequency Connector]

Figure 2A:
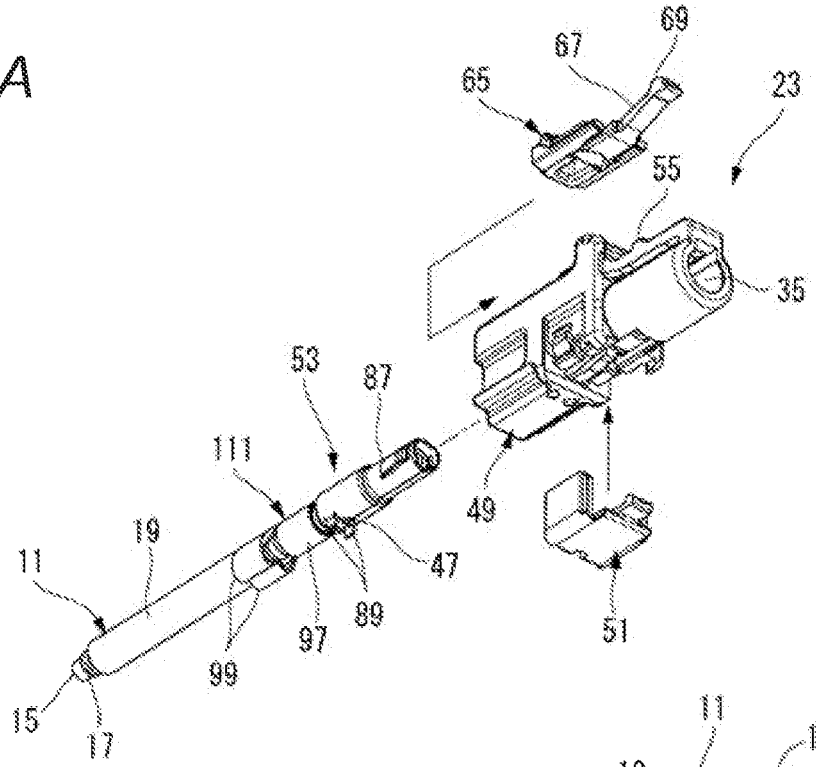
FIG. 2A is an exploded perspective view of the female high-frequency connector shown in FIGS. 1A and 1B.
Figure 2B:
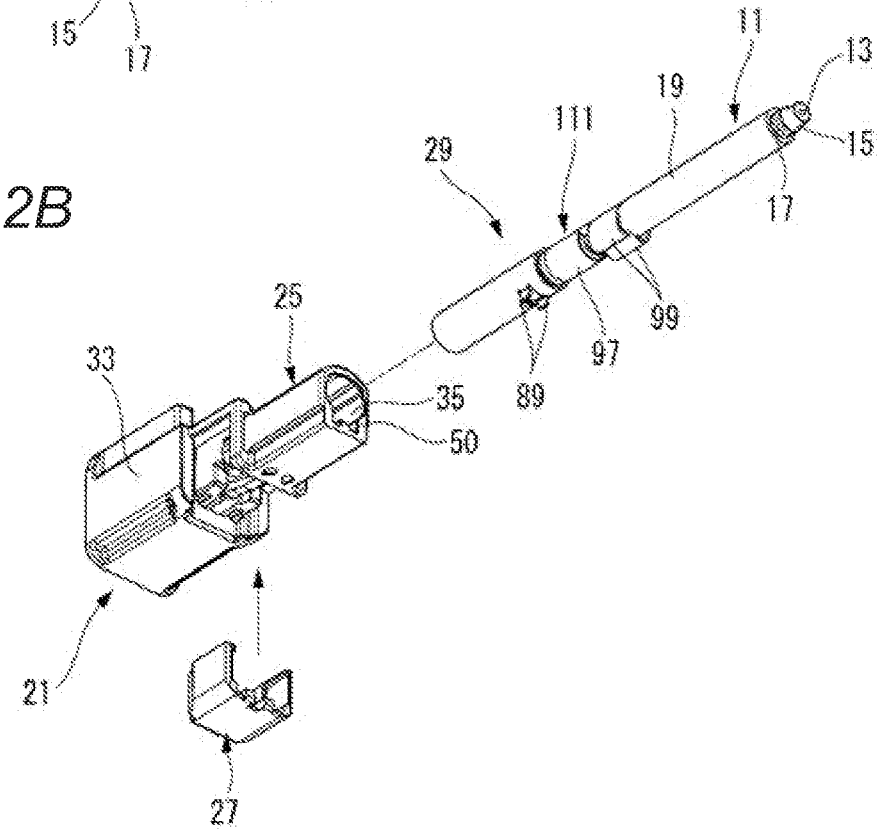
FIG. 2B is an exploded perspective view of the male high-frequency connector shown in FIGS. 1A and 1B.

FIG. 2A is an exploded perspective view of the female high-frequency connector 23 shown in FIGS. 1A and 1B, and FIG. 2B is an exploded perspective view of the male high-frequency connector 21 shown in FIGS. 1A and 1B.

The male high-frequency connector 21 includes a male outer housing 25, a male side spacer 27, and a male shield assembly 29. The male outer housing 25 is molded of a synthetic resin having the electrical insulation property. The male side spacer 27 is molded of a synthetic resin having the electrical insulation property. The male outer housing 25 has a hood portion 33 provided with a to-be-locked portion 31 (see FIGS. 1A and 1B).

FIG. 3 is a cross-sectional view of the fitted female high-frequency connector 23 and the male high-frequency connector 21 in a direction along the core wire 13.

A terminal accommodating chamber 35 is molded in the male outer housing 25 so as to penetrate the male outer housing 25 in a front-rear direction. An elastic locking piece 37 (flexible lance) is formed in the male outer housing 25 so as to protrude into the terminal accommodating chamber 35. A spacer insertion hole 39 that crosses a part of the terminal accommodating chamber 35 in a direction intersecting with a terminal insertion direction is formed in the male outer housing 25.

The male shield assembly 29 includes a male inner terminal 41, a male inner housing 43, and a male shield outer terminal 45. The male inner terminal (inner terminal) 41 is formed of a metal having the conductivity in a tab shape or a pin shape. The male inner housing (inner housing) 43 is molded of a synthetic resin having the electrical insulation property. The male shield outer terminal 45 is formed of a metal having the conductivity in a tubular shape or a pair of holding pieces. The male shield assembly 29 is connected to an end of the cable 11.

The male shield assembly 29 connected to the end of the cable 11 is inserted into the terminal accommodating chamber 35 of the male outer housing 25. The male shield assembly 29 inserted into the terminal accommodating chamber 35 is held in the terminal accommodating chamber 35 of the male outer housing 25 by locking a locking projection 47 provided on the male shield assembly 29 to the elastic locking piece 37 in the terminal accommodating chamber 35.

The male side spacer 27 is assembled into the spacer insertion hole 39 of the male outer housing 25 so as to be inserted in a direction crossing the terminal accommodating chamber 35. In the male outer housing 25 to which the male shield assembly 29 is mounted, when a tensile three in a right direction in FIG. 3 is applied to the cable 11, the elastic locking piece 37 tends to elastically deform by a moment such that a locking between the locking projection 47 and the elastic locking piece 37 is released. At this time, the male side spacer 27 regulates an elastic deformation of the elastic locking piece 37 to ensure a locking state of the locking projection 47 of the male shield assembly 29 and the elastic locking piece 37.

[Female High-Frequency Connector]

As shown in FIGS. 2A, 2B and 3, the female high-frequency connector 23 includes a female outer housing 49, a female side spacer 51, and a female shield assembly 53. The female outer housing 49 is molded of a synthetic resin having the electrical insulation property. The female side spacer 51 is molded of a synthetic resin having the electrical insulation property. The female outer housing 49 includes an elastically deformable lock arm 57 provided with a lock projection 55.

The terminal accommodating chamber 35 is molded in the female outer housing 49 so as to penetrate the female outer housing 49 in the front-rear direction. The elastic locking piece 37 (flexible lance) is formed in the female outer housing 49 so as to protrude into the terminal accommodating chamber 35. The spacer insertion hole 39 that crosses a part of the terminal accommodating chamber 35 in the direction intersecting with the terminal insertion direction is formed in the female outer housing 49.

The female shield assembly 53 includes a female inner terminal 59, a female inner housing 61, and a female shield outer terminal 63. The female inner terminal (inner terminal) 59 is formed of a metal having the conductivity in a tubular shape. The female inner housing (inner housing) 61 is molded of a synthetic resin having the electrical insulation property. The female shield outer terminal 63 is formed of a metal having the conductivity in a tubular shape or a pair of holding pieces. The female shield assembly 53 is connected to an end of the cable 11.

The female shield assembly 53 connected to the end of the cable 11 is inserted into the terminal accommodating chamber 35 of the female outer housing 49. The female shield assembly 53 inserted into the terminal accommodating chamber 35 of the female outer housing 49 is held in the terminal accommodating chamber 35 of the female outer housing 49 by locking the elastic locking piece 37 in the terminal accommodating chamber 35 to the locking projection 47 provided on the female shield assembly 53.

The female side spacer 51 is assembled into the spacer insertion hole 39 of the female outer housing 49 so as to be inserted in the direction crossing the terminal accommodating chamber 35. In the female outer housing 49 on which the female shield assembly 53 is mounted, when a tensile force in a left direction in FIG. 3 is applied to the cable 11, the elastic locking piece 37 tends to elastically deform by a moment such that a locking between the locking projection 47 and the elastic locking piece 37 is released. At this time, the female side spacer 51 regulates an elastic deformation of the elastic locking piece 37 to ensure a locking state of the locking projection 47 of the female shield assembly 53 and the elastic locking piece 37.

The female outer housing 49 includes a fitting detection member 65 (connector position assurance: CPA) that detects and ensures proper fitting with the male outer housing 25. The fitting detection member 65 is attached to a side face of the female outer housing 49 so as to be movable between a temporary locking position and a main locking position in a connector fitting direction. When the female outer housing 49 and the male outer housing 25 are completely fitted, that is, when the female high-frequency connector 23 and the male high-frequency connector 21 are completely fitted, the fitting detection member 65 can move from the temporary locking position to the main locking position (fitting assurance position).

[Fitting of Male High-Frequency Connector and Female High-Frequency Connector]

The male high-frequency connector 21 and the female high-frequency connector 23 are fitted as shown in FIGS. 1B and 3. When the female high-frequency connector 23 is inserted into the hood portion 33 of the male high-frequency connector 21 and the male high-frequency connector 21 and the female high-frequency connector 23 are fitted, the lock projection 55 of the lock arm 57 is engaged with the to-be-locked portion 31. Accordingly, the male high-frequency connector 21 and the female high-frequency connector 23 are maintained in a fitted state.

In the fitted state, the fitting detection member 65 provided on the female outer housing 49 is moved from the temporary locking position to the main locking position shown in FIG. 3. The fitting detection member 65 detects the proper fitting between the male high-frequency connector 21 and the female high-frequency connector 23 by engaging a detection portion 69 provided at a tip end of a detection arm 67 with the lock projection 55 engaged with the to-be-locked portion 31. The fitting detection member 65 is moved to the main locking position where the proper fitting between the male high-frequency connector 21 and the female high-frequency connector 23 is detected. Then, a lock arm regulating portion 71 is inserted into a release space of a lock release piece 73 of the lock arm 57, making it impossible to unlock the lock arm 57. That is, the fitting detection member 65 detects the proper fitting and operates to ensure the proper fitting.

In the fitted state, the male shield assembly 29 connected to the one end of the cable 11 and the female shield assembly 53 connected to the other end of the cable 11 are electrically connected. That is, the male inner terminal 41 and the female inner terminal 59 are electrically connected, and the core wires 13 of the cable 11 are electrically connected to form a communication circuit. At the same time, the male shield outer terminal 45 and the female shield outer terminal 63 are electrically connected, and the braids 17 of the cable 11 are electrically connected to form a shield circuit.

[Female Shield Assembly]

FIG. 4 is an exploded perspective view of the female shield assembly 53 shown in FIG. 2A.

The female shield assembly 53 includes the female inner terminal 59, the female inner housing 61, and the female shield outer terminal 63. The female shield outer terminal 63 includes three parts of a female shield body (shield body) 75, a female shield sleeve (shield sleeve) 77, and a female crimping member (crimping member) 79.

The female inner terminal 59 is electrically connected to the core wire 13 of the cable 11 by crimping. The female shield body 75 has a substantially cylindrical shape. A front cylindrical connecting portion 81 and an enlarged diameter portion 83 having an enlarged diameter are molded in the female shield body 75 from a front to a rear. An inner housing accommodating chamber 85 is molded in the female shield body 75 so as to penetrate the female shield body 75 in the front-rear direction. In the present specification, the front refers to a direction in which the connector advances in the fitting direction, and the rear refers to a direction opposite to the front.

An elastically deformable contact piece 87 is molded by cutting and rising in the front cylindrical connecting portion 81. The contact piece 87 forms a mechanism that elastically contacts and is electrically connected to the male shield outer terminal 45 (see FIG. 5) in a state where the male high-frequency connector 21 is fitted. The female shield body 75 is molded by cutting and raising a pair of parallel standing pieces 89 at a rear portion of the enlarged diameter portion 83. The standing pieces 89 form a stabilizer that determines an insertion posture of the female shield assembly 53 by being inserted into a guide groove 50 (see FIGS. 1A and 1B) formed in the female outer housing 49.

The female shield sleeve (shield sleeve) 77 is formed in a substantially cylindrical shape. The female shield sleeve 77 is made of a metal having the conductivity, and is formed in a tubular shape in which a fitting portion 91 and a braid covered portion 93 are continuous from the front to the rear.

The fitting portion 91 has a tubular shape having a diameter larger than that of the braid covered portion 93, and is molded coaxially with the braid covered portion 93. An insertion space is formed in the female shield sleeve 77 so as to penetrate the female shield sleeve 77 in the front-rear direction.

The female crimping member (crimping member) 79 is made of a metal having the conductivity and is formed in a shape. The female crimping member 79 is integrally formed by connecting a braid crimping piece 97 and a sheath crimping piece 99 in the front-rear direction via a connecting portion 95.

In the female shield assembly 53 connected to the end of the cable 11, the female inner terminal 59 is accommodated in an inner terminal accommodating chamber 101 of the female inner housing 61. The female inner housing 61 accommodating the female inner terminal 59 is accommodated in the inner housing accommodation chamber 85 of the female shield body 75. The female inner housing 61 has a large diameter portion 103 at a central portion in an insertion direction, and a front cylindrical portion 105 and a rear cylindrical portion 107 having a diameter smaller than that of the large diameter portion 103 at the front and rear of the large diameter portion 103 that sandwich the large diameter portion 103.

The fitting portion 91 of the female shield sleeve 77 is fitted into the enlarged diameter portion 83 of the female shield body 75. The female shield body 75 and the female shield sleeve 77 are integrated, and the enlarged diameter portion 83 and the fitting portion 91 are press-fitted, then joined by solder, and held.

The enlarged diameter portion 83 and the fitting portion 91 may be held by press-fitting only, solder joining only, or by a locking mechanism or the like.

In the braid covered portion 93 of the female shield sleeve 77, the braid 17 of the cable 11 covers an outer periphery of the braid covered portion 93. The female crimping member 79 is crimped so that the braid crimping piece 97 covers the outer periphery of the braid 17. The braid covered portion 93, the braid 17 and the braid crimping piece 97 are solder-joined by a solder 109 (see FIG. 3).

The sheath crimping piece 99 of the female crimping member 79 is crimped to the sheath 19 of the cable 11 from an outer periphery. That is, in the female shield assembly 53, the female crimping member 79 is fixed to both the braid 17 and the sheath 19.

The braid covered portion 93, the braid 17, and the braid crimping piece 97, and the solder 109, joining the braid covered portion 93, the braid 17, and the braid crimping piece 97 form a braid crimping portion 111.

[Male Shield Assembly]

Figure 5:
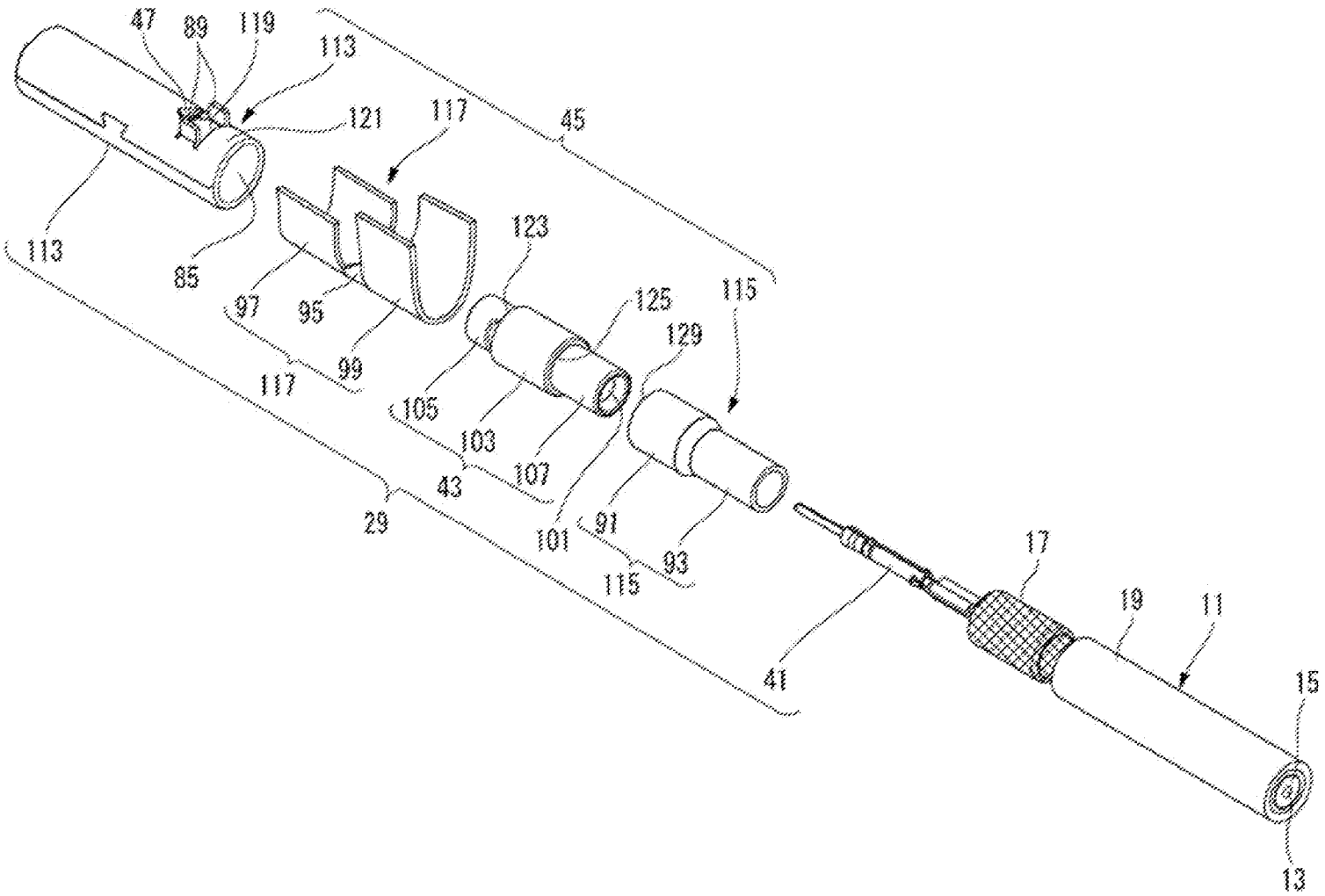
FIG. 5 is an exploded perspective view of a male shield assembly shown in FIG. 2B.

FIG. 5 is an exploded perspective view of the male shield assembly 29 shown in FIG. 2B.

The male shield assembly 29 includes the male inner terminal 41, the male inner housing 43, and the male shield outer terminal 45. The male shield outer terminal 45 includes three parts of a male shield body 113, a male shield sleeve (shield sleeve) 115, and a male crimping member (crimping member) 117.

The male shield body 113 of the male shield assembly 29 is formed in a cylindrical shape that receives the front cylindrical connecting portion 81 of the female shield body 75. The contact piece 87 formed in the front cylindrical connecting portion 81 of the female shield body 75 contacts an inner periphery of the male shield body 113.

In the male shield assembly 29 connected to the end of the cable 11, the male inner terminal 41 is accommodated in the inner terminal accommodating chamber 101 of the male inner housing 43. The male inner housing 43 accommodating the male inner terminal 41 is accommodated in the inner housing accommodation chamber 85 of the male shield body 113.

Since the other configuration of the male shield assembly 29 is substantially similar as that of the above female shield assembly 53, a redundant description is omitted.

[Details of Female Shield Assembly Connected to End of Cable]

Figure 6A:
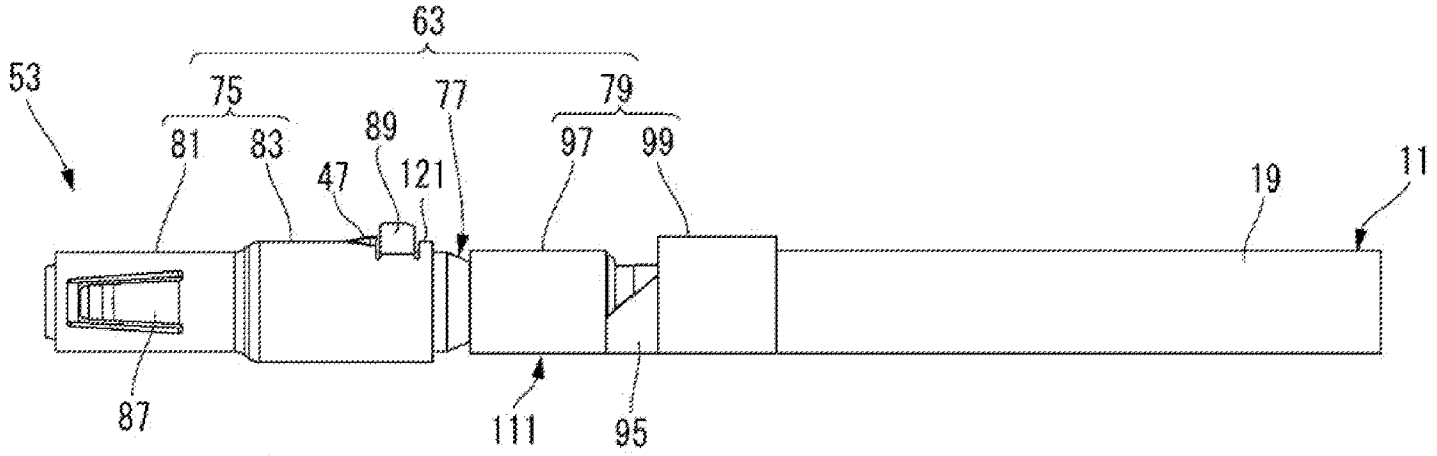
FIG. 6A is a side view of a cable to which the female shield assembly is attached.
Figure 6B:
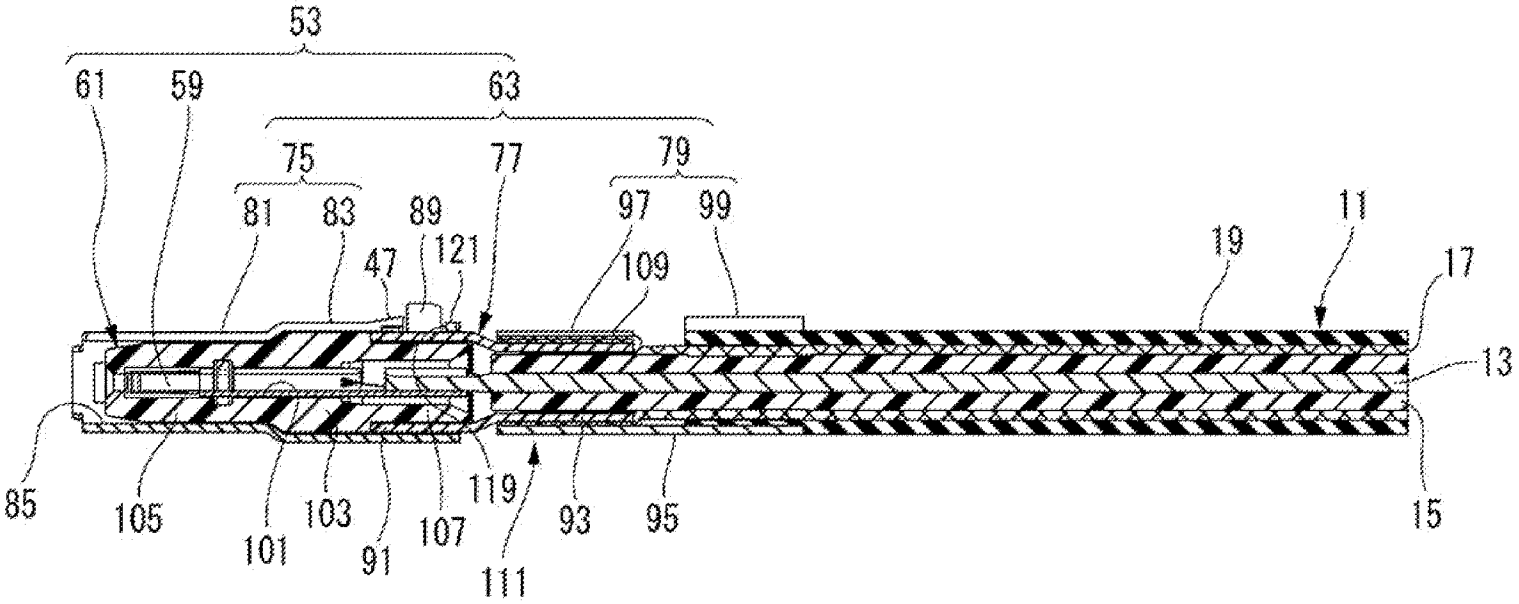
FIG. 6B is a cross-sectional view in a direction along the core wire of FIG. 6A.

FIG. 6A is a side view of the cable 11 to which the female shield assembly 53 is attached, and FIG. 6B is a cross-sectional view in the direction along the core wire 13 of FIG. 6A.

In the female shield assembly 53, the fitting portion 91 of the female shield sleeve 77 is fixed to the female shield body 75 into which the female inner housing 61 is inserted. The female shield sleeve 77 is integrally fixed together with the braid crimping piece 97 in a state in which the rear braid covered portion 93 is inserted between the insulator 15 and the braid 17 of the cable 11. In the female crimping member 79, the sheath crimping piece 99 connected to the braid crimping piece 97 via the connecting portion 95 is crimped to the sheath 19 of the cable 11. Accordingly, the female shield assembly 53 is firmly attached to the cable 11 by the solder 109 and a crimping structure.

Figures 7A, 7B, 7C:
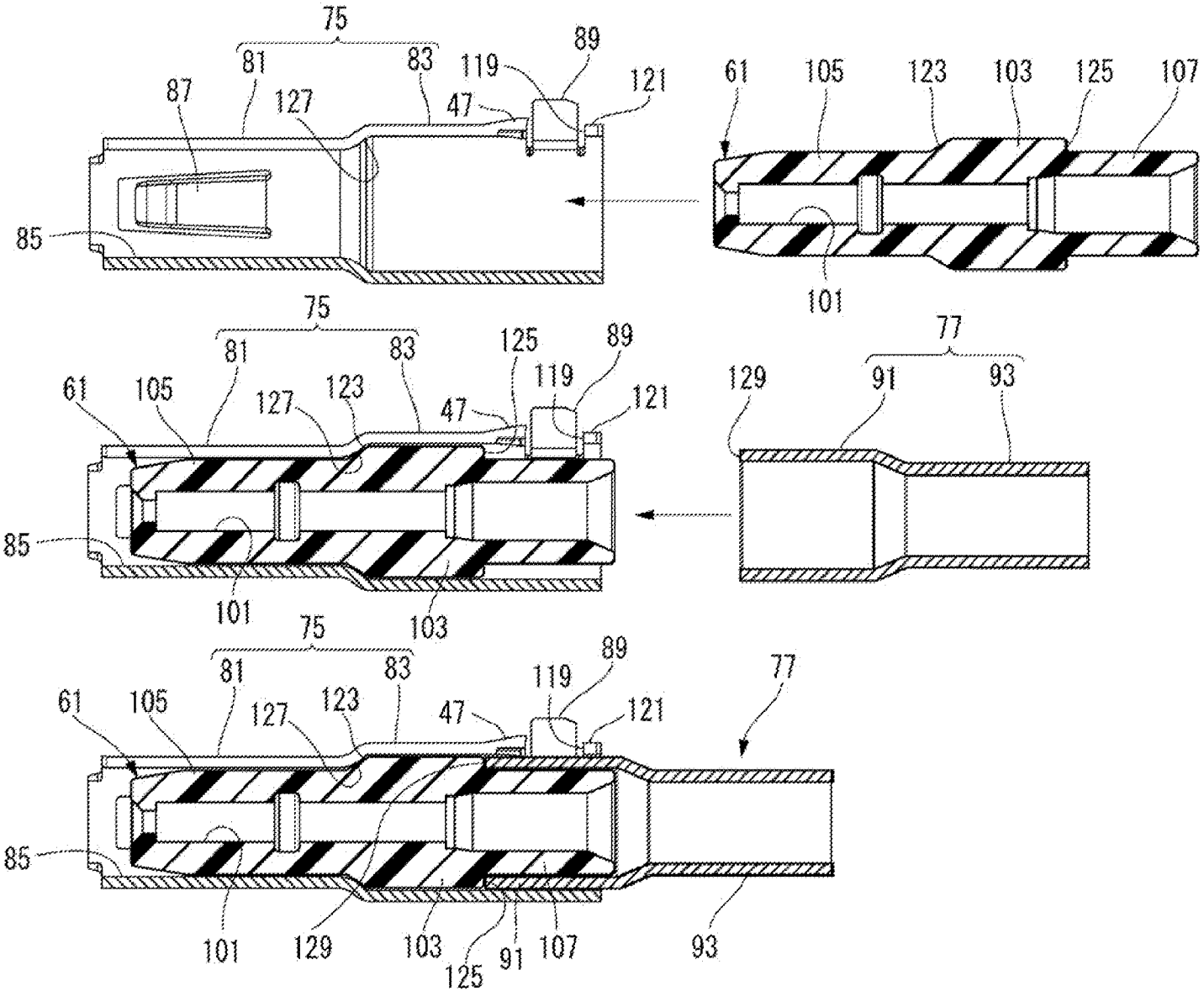
FIG. 7A is a cross-sectional view of a female shield body before a female inner housing is assembled.
FIG. 7B is a cross-sectional view of the female shield body and the female inner housing before a female shield sleeve is assembled.
FIG. 7C is a cross-sectional view of the female shield body to which the female inner housing is assembled and the female shield sleeve is fitted.

FIG. 7A is a cross-sectional view of the female shield body 75 before the female inner housing 61 is assembled, FIG. 7B is a cross-sectional view of the female shield body 75 and the female inner housing 61 before the female shield sleeve 77 is assembled, and FIG. 7C is a cross-sectional view of the female shield body 75 to which the female inner housing 61 is assembled and the female shield sleeve 77 is fitted.

The female shield assembly 53 of the female high-frequency connector 23 is formed with a hole 119 caused by cutting and raising a pair of parallel standing pieces 89 to form the stabilizer in a rear portion of the female shield body 75 on a core wire lead-out side. The hole 119 is closed from an inside by the fitting portion 91 of the female shield sleeve 77 fitted into the enlarged diameter portion 83 of the female shield body 75 from the rear.

The hole 119 is closed by a peripheral connecting portion 121 at a further rear of the hole 119 extending in a circumferential direction of the female shield body 75. The peripheral connecting portion 121 contacts an outer periphery of the fitting portion 91 that is fitted into the enlarged diameter portion 83 of the female shield body 75 from the rear, and is electrically connected to the female shield sleeve 77 soldered to the braid 17.

The large diameter portion 103 is formed on an outer periphery of the female inner housing 61 in a middle in a direction along an axial line, and the large diameter portion 103 has an inclined contact portion 123 at the front and a vertical pressed portion 125 at the rear. The female shield body 75 is formed with the enlarged diameter portion 83 into which the large diameter portion 103 is fitted so that a boundary with a front portion serves as a contact receiving portion 127. In the female inner housing 61 inserted into the enlarged diameter portion 83 of the female shield body 75, the contact portion 123 contacts the contact receiving portion 127, and the pressed portion 125 is pressed by a pressing portion 129 formed in the fitting portion 91 of the female shield sleeve 77.

Figure 8:
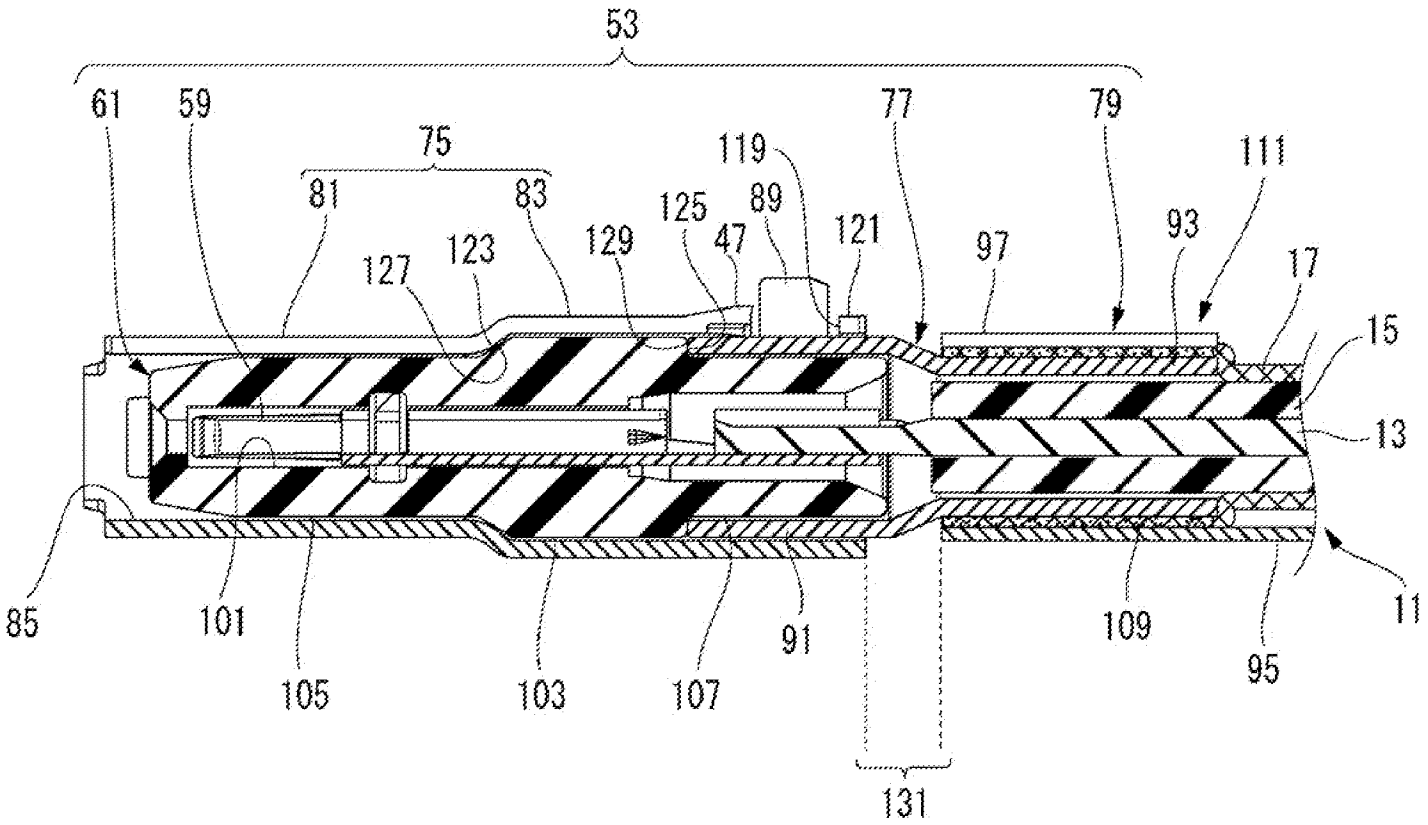
FIG. 8 is a cross-sectional view of main parts of the female shield body and a female crimping member attached to an end of the cable in the direction along the core wire.

FIG. 8 is a cross-sectional view of main parts of the female shield body 75 and the female crimping member 79 attached to the end of the cable 11 in the direction along the core wire 13.

The above female shield assembly 53 includes: the female inner terminal 59 connected to the core wire 13 of the cable 11 in which the outer periphery of the insulator 15 covering the core wire 13 is covered with the braid 17; the female inner housing 61 which has the inner terminal accommodating chamber 101 accommodating the female inner terminal 59 and in which the female inner terminal 59 is mounted in the inner terminal accommodating chamber 101; the tubular female shield body 75 covering the outer periphery of the female inner housing 61; the female crimping member 79 having the braid crimping piece 97 that is crimped from above the braid 17; and the tubular female shield sleeve 77 having the tubular braid covered portion 93 that is inserted between the insulator 15 and the braid 17 and having the fitting portion 91 that extends from the braid covered portion 93 and is inserted between the outer periphery of the female inner housing 61 and an inner periphery of the female shield body 75 to cover a gap 131 between the braid crimping piece 97 and the female shield body 75.

A configuration of the male shield assembly 29 is substantially the same as the above except for a difference between male and female.

Next, an operation of the above configuration will be described by taking the female high-frequency connector 23 as an example.

In the female high-frequency connector 23 according to the present embodiment, the female inner terminal 59 connected to the end of the cable 11 is accommodated in the inner terminal accommodating chamber 101 of the female inner housing 61. The outer periphery of the female inner housing 61 is covered with the tubular female shield body 75. In the cable 11, an outer periphery of the core wire 13 to which the female inner terminal 59 is connected is covered with the insulator 15, and further, the outer periphery of the insulator 15 is covered with the braid 17.

In the cable 11, the braid 17 is crimped by the braid crimping piece 97 of the female crimping member 79. The braid covered portion 93 of the female shield sleeve 77 formed in the tubular shape is inserted between the braid 17 and the insulator 15 in the cable 11. That is, the braid 17 is sandwiched between the braid covered portion 93 and the braid crimping piece 97, and is crimped to the braid covered portion 93.

In the female shield sleeve 77 having the braid covered portion 93, a side opposite to the braid covered portion 93, as the fitting portion 91, is inserted between the female inner housing 61 and the female shield body 75. Accordingly, the female shield sleeve 77 fills the peripheral gap 131 (see FIG. 8) formed between a rear edge of the female shield body 75 and a front edge of the braid crimping piece 97 (connected in a peripheral shape).

Therefore, in the female high-frequency connector 23 of the present embodiment, when a return current flows through the female shield body 75 and the braid crimping piece 97 forming the shield circuit as in a structure in the related art, the return current does not flow being displaced (concentrated) to the connecting portion 95 existing only on a lower side. That is, in the female high-frequency connector 23 of the present embodiment, a reduction in a transmission performance between the cable 11 and the female shield body 75 can be prevented by eliminating a bias of a current in an axial direction.

In addition, in the female high-frequency connector 23 of the present embodiment, by filling the gap 131 occurred between the female shield body 75 and the female crimping member 79 by the fitting portion 91 of the female shield sleeve 77, it is also possible to prevent noise from entering and exiting from the gap 131, thereby preventing a reduction in a noise shielding performance.

As a result, in the female high-frequency connector 23 of the present embodiment, it is possible to improve a communication performance in the communication circuit by preventing the reduction in the transmission performance and the reduction in the noise shielding performance.

In the female high-frequency connector 23 of the present embodiment, the fitting portion 91 of the female shield sleeve 77 is inserted into the rear portion of the female shield body 75. In a state in which the female shield body 75 and the female shield sleeve 77 are integrated, the fitting portion 91 of the female shield sleeve 77 blocks the hole 119 formed in the female shield body 75 caused by cutting and raising the pair of standing pieces 89.

Therefore, in the female high-frequency connector 23 of the present embodiment, it is possible to prevent the noise from entering and exiting from the hole 119 caused by cutting and raising the pair of standing pieces 89, and it is possible to prevent the reduction in the noise shielding performance due to the pair of standing pieces 89 being cut and raised, and it is possible to improve the communication performance in the communication circuit.

In the female high-frequency connector 23 of the present embodiment, the hole 119 of the female shield body 75 caused by cutting and raising the pair of standing pieces 89 is closed by the peripheral connecting portion 121 at the rear, and does not become a notch hole opened at a rear end portion side of the female shield body 75. That is, by providing the peripheral connecting portion 121 at a rear end portion of the female shield body 75, when the fitting portion 91 of the female shield sleeve 77 is fitted between the female shield body 75 and the female inner housing 61, the peripheral connecting portion 121 is electrically connected (grounded) to the outer periphery of the fitting portion 91 in the circumferential direction. Therefore, in the female high-frequency connector 23 of the present embodiment, even though the hole 119 is formed by cutting and raising the pair of standing pieces 89, the peripheral connecting portion 121 at the rear end portion of the female shield body 75 and the fitting portion 91 of the female shield sleeve 77 contact with each other along an entire circumference in the circumferential direction, so that it is possible to make resistance in an electrical connection uniform (no potential difference occurs) and improve an electrical connection performance.

Further, in the female high-frequency connector 23 of the present embodiment, the female inner housing 61 is inserted into the female shield body 75. Then, the front contact portion 123 formed in the large diameter portion 103 of the female inner housing 61 contacts the contact receiving portion 127 inside the enlarged diameter portion 83 of the female shield body 75, and further insertion is regulated. Then, the fitting portion 91 of the female shield sleeve 77 is fitted into the female shield body 75 from the rear portion into which the female inner housing 61 is inserted. Then, the pressing portion 129, which is a tip end of the fitting portion 91 in a fitting direction, presses the pressed portion 125 formed at the rear of the large diameter portion 103 of the female inner housing 61 in the fitting direction. In this state, the female shield sleeve 77 is integrally fixed to the female shield body 75 by press fitting or the like.

That is, the contact portion 123 and the contact receiving portion 127 contact with each other, the pressing portion 129 and the pressed portion 125 contact with each other, and the female shield body 75 and the female shield sleeve 77 are integrated, so that the female inner housing 61 is accommodated in the female shield body 75 and the female shield sleeve 77 without rattling.

Accordingly, the female high-frequency connector 23 of the present embodiment is fitted to the mate high-frequency connector 21 which is a mating connector, and in a state where the female high-frequency connector 23 is mounted on a vehicle, rattling of the female inner housing 61 is prevented even if vibration is applied when the vehicle is running. As a result, in a connection structure between the female inner terminal 59 and the male inner terminal 41, slight sliding wear between the terminals can be prevented, and a reduction in electrical connection reliability can be prevented.

Therefore, according to the female high-frequency connector 23 and the male high-frequency connector 21 according to the present embodiment, it is possible to improve the communication performance by preventing the reduction in the noise shielding performance and the reduction in the transmission performance.

Figure 9:
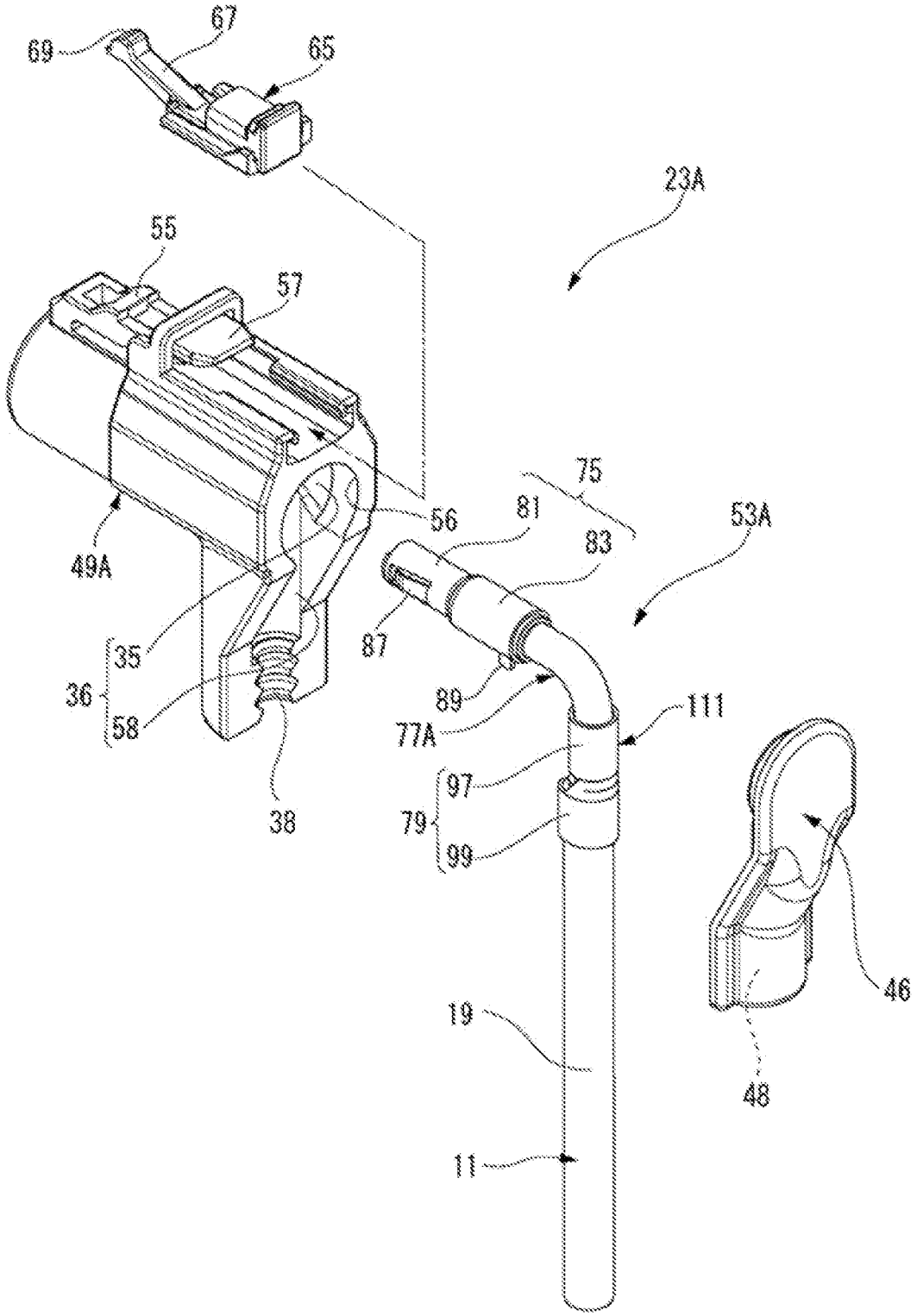
FIG. 9 is an exploded perspective view of a female high-frequency connector according to another embodiment of the present invention.

FIG. 9 is an exploded perspective view of a female high-frequency connector 23A according to another embodiment of the present invention. The same reference signs are given to a configuration of the female high-frequency connector 23A similar to that of the female high-frequency connector 23, and a redundant description is omitted.

[Female High-Frequency Connector]

As shown in FIG. 9, the female high-frequency connector 23A according to the present embodiment includes a female outer housing 49A, a female shield assembly 53A, and a cover 46.

The female outer housing 49A is a substantially L-shaped housing formed of a synthetic resin having the electrical insulation property and is formed with a shield assembly accommodating chamber 36. The shield assembly accommodating chamber 36 is formed in an L shape by the terminal accommodating chamber 35 which penetrates the shield assembly accommodating chamber 36 in the front-rear direction and an electric wire accommodating groove 58 extending downward that intersects with the terminal accommodating chamber 35 in the front-rear direction from a rear end of the terminal accommodating chamber 35, and communicates with the outside through a rear end opening 56.

In the female shield assembly 53A accommodated in the shield assembly accommodating chamber 36 from the rear end opening 56, the female shield body (shield body) 75 is accommodated in the terminal accommodating chamber 35, and the female crimping member 79 and the end of the cable 11 are accommodated in the electric wire accommodating groove 58.

The female shield body 75 inserted into the terminal accommodating chamber 35 of the female outer housing 49A is held in the terminal accommodating chamber 35 by the locking projection 47 being locked to the elastic locking piece 37 (not shown) in the terminal accommodating chamber 35.

A plurality of semi-annular ribs 38 are provided in a portion of the electric wire accommodating groove 58 from which the cable 11 is led out.

The cover 46 is molded into a substantially plate shape by a synthetic resin having the electrical insulation property, and is attached by being welded from a rear side of the female outer housing 49A by ultrasonic vibration, laser light, or the like so as to cover the rear end opening 56. The cover 46 is provided with a similar semi-annular rib 48 at a portion corresponding to the semi-annular rib 38 of the female outer housing 49A. When the cover 46 is attached to the female outer housing 49A, the semi-annular rib 38 and the semi-annular rib 48 bite into the sheath 19 of the cable 11 and can hold the cable 11 in a watertight manner.

[Female Shield Assembly]

Figure 10:
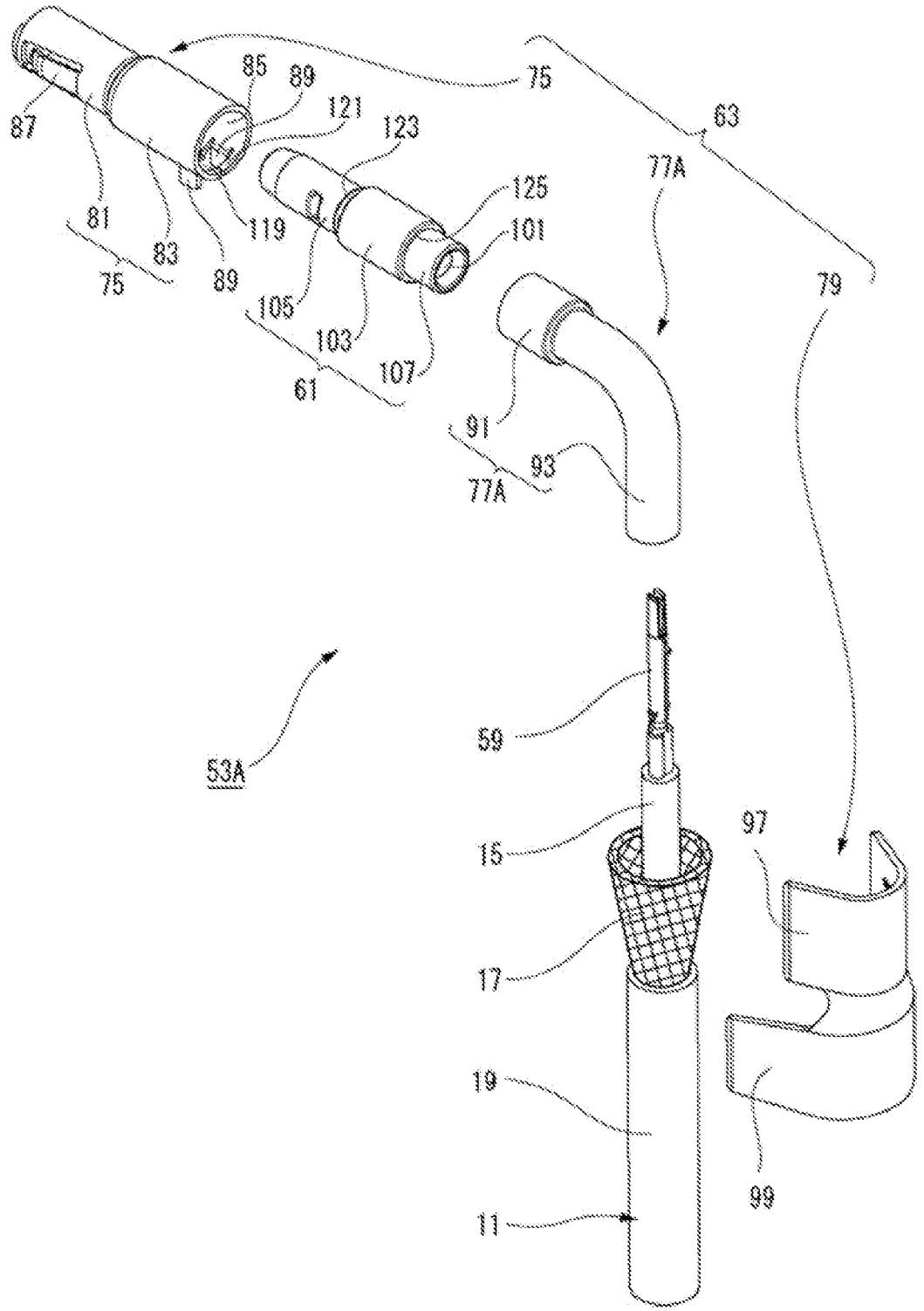
FIG. 10 is an exploded perspective view of a female shield assembly shown in FIG. 9.

FIG. 10 is an exploded perspective view of the female shield assembly 53A shown in FIG. 9. The same reference signs are given to a configuration of the female shield assembly 53A similar to that of the female shield assembly 53, and a redundant description is omitted.

As shown in FIG. 10, the female shield assembly 53A includes the female inner terminal 59, the female inner housing 61, and the female shield outer terminal 63. The female shield assembly 53A is connected to the end of the cable 11.

The female shield outer terminal 63 includes three parts of the female shield body 75, the female shield sleeve (shield sleeve) 77A, and the female crimping member (crimping member) 79.

The female shield sleeve 77A is formed by bending a cylinder into a substantially L shape. The female shield sleeve 77A is made of a metal having the conductivity, and is formed into the L-shaped tubular shape in which the fitting portion 91 and the braid covered portion 93 are continuous from the front to the rear. The fitting portion 91 has a tubular shape having the diameter larger than that of the braid covered portion 93, and is molded on an intersecting axis orthogonal to the braid covered portion 93. An insertion space is formed in the female shield sleeve 77A so as to penetrate the female shield sleeve 77A in an orthogonal direction.

In the female shield assembly 53A connected to the end of the cable 11, the female inner terminal 59 penetrating the female shield sleeve 77A is accommodated in the inner terminal accommodating chamber 101 of the female inner housing 61. The female inner housing 61 accommodating the female inner terminal 59 is accommodated in the inner housing accommodation chamber 85 of the female shield body 75. The female inner housing 61 has a large diameter portion 103 at a central portion in an insertion direction, and a front cylindrical portion 105 and a rear cylindrical portion 107 having a diameter smaller than that of the large diameter portion 103 at the front and rear of the large diameter portion 103 that sandwich the large diameter portion 103.

The fitting portion 91 of the female shield sleeve 77A is fitted into the enlarged diameter portion 83 of the female shield body 75. The female shield body 75 and the female shield sleeve 77A are integrated, and the enlarged diameter portion 83 and the fitting portion 91 are press-fitted, then joined by solder, and held.

In the braid covered portion 93 of the female shield sleeve 77A, the braid 17 of the cable 11 covers the outer periphery of the braid covered portion 93. The female crimping member 79 is crimped so that the braid crimping piece 97 covers the outer periphery of the braid 17. The braid covered portion 93, the braid 17 and the braid crimping piece 97 are solder-joined by the solder 109 (see FIG. 11).

The sheath crimping piece 99 of the female crimping member 79 is crimped to the sheath 19 of the cable 11 from the outer periphery. That is, in the female shield assembly 53A, the female crimping member 79 is fixed to both the braid 17 and the sheath 19.

The braid covered portion 93, the braid 17, and the braid crimping piece 97, and the solder 109 joining the braid covered portion 93, the braid 17, and the braid crimping piece 97 form the braid crimping portion 111.

[Details of Female Shield Assembly Connected to End of Cable]

Figure 11:
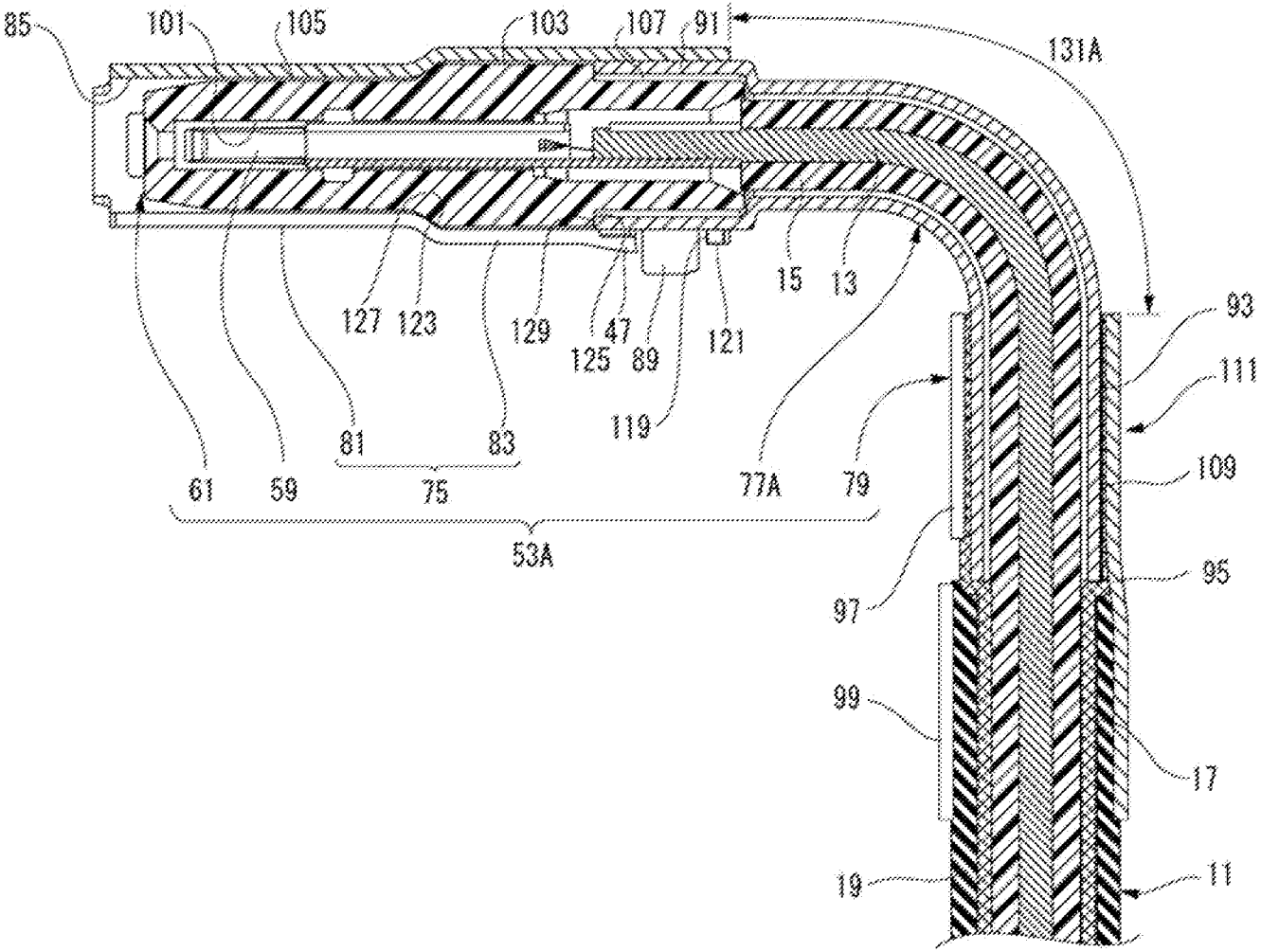
FIG. 11 is a cross-sectional view in the direction along the core wire of the cable to which the female shield assembly shown in FIG. 10 is attached.

FIG. 11 is a cross-sectional view in the direction along the core wire 13 of the cable 11 to which the female shield assembly 53A shown in FIG. 10 is attached.

As shown in FIG. 11, in the female shield assembly 53A, the fitting portion 91 of the female shield sleeve 77A is integrally fixed to the female shield body 75 into which the female inner housing 61 is inserted by press-fitting or the like. The female shield sleeve 77A is integrally fixed together with the braid crimping piece 97 in the state in which the rear braid covered portion 93 is inserted between the insulator 15 and the braid 17 of the cable 11. In the female crimping member 79, the sheath crimping piece 99 connected to the braid crimping piece 97 via the connecting portion 95 is crimped to the sheath 19 of the cable 11. Accordingly, the female shield assembly 53A is firmly attached to the cable 11 by the solder 109 and the crimping structure.

The female shield assembly 53A of the female high-frequency connector 23A is formed with the hole 119 caused by cutting and raising the pair of parallel standing pieces 89 to form the stabilizer in the rear portion of the female shield body 75 on the core wire lead-out side. The hole 119 is closed from an inside by the fitting portion 91 of the female shield sleeve 77A fitted into the enlarged diameter portion 83 of the female shield body 75 from the rear.

The hole 119 is closed by the peripheral connecting portion 121 at the further rear of the hole 119 extending in the circumferential direction of the female shield body 75. The peripheral connecting portion 121 contacts the outer periphery of the fitting portion 91 that is fitted into the enlarged diameter portion 83 of the female shield body 75 from the rear, and is electrically connected to the female shield sleeve 77A soldered to the braid 17.

The female shield assembly 53A of the present embodiment described above includes: the female inner terminal 59 connected to the core wire 13 of the cable 11 in which the outer periphery of the insulator 15 covering the core wire 13 is covered with the braid 17; the female inner housing 61 which has the inner terminal accommodating chamber 101 accommodating the female inner terminal 59 and in which the female inner terminal 59 is mounted in the inner terminal accommodating chamber 101; the tubular female shield body 75 covering the outer periphery of the female inner housing 61; the female crimping member 79 having the braid crimping piece 97 that is crimped from above the braid 17; and the L-shaped tubular female shield sleeve 77A having the tubular braid covered portion 93 that is inserted between the insulator 15 and the braid 17 and having the fitting portion 91 that extends from the braid covered portion 93 and is inserted between the outer periphery of the female inner housing 61 and the inner periphery of the female shield body 75 to cover a gap 131A between the braid crimping piece 97 and the female shield body 75.

Therefore, according to the female high-frequency connector 23A of the present embodiment, similar as in the female high-frequency connector 23 of the above embodiment, it is possible to improve the communication performance by preventing the reduction in the noise shielding performance and the reduction in the transmission performance.

Further, according to the female high-frequency connector 23A of the present embodiment, the female shield sleeve 77A is bent in the L shape, so that the female shield body 75 and the female crimping member 79 to which the end of the cable 11 is connected are orthogonal to each other. A pull-out direction of the cable 11 can be regulated in a direction orthogonal to the female shield body 75.

Accordingly, it is possible to easily form the female high-frequency connector 23A which the female shield assembly 53A is mounted on the female outer housing 49A formed in the substantially L shape. As a result, it is not necessary to use an outer conductor terminal that is difficult to form and is bent to a substantially L shape while continuously maintaining a complete tubular shape over an entire length.

The present invention is not limited to the embodiments described above, and may be appropriately modified, improved, and the like. In addition, materials, shapes, dimensions, numbers, arrangement positions, and the like of components in the embodiments described above are optional and are not limited as long as the present invention can be achieved.

Here, characteristics of the embodiments of the high-frequency connector according to the present invention described above are summarized briefly in the following [1] to [5].

[1] A high-frequency connector (male high-frequency connector 21, female high-frequency connectors 23, 23A) including:

an inner terminal (male inner terminal 41, female inner terminal 59) connected to a core wire (13) of a cable (11) in which an outer periphery of an insulator (15) covering the core wire is covered with a braid (17);

an inner housing (male inner housing 43, female inner housing 61) accommodating the inner terminal in an inner terminal accommodating chamber (101);

a tubular shield body (male shield body 113, female shield body 75) covering an outer periphery of the inner housing;

a crimping member (male crimping member 117, female crimping member 79) having a braid crimping piece (97) that is crimped from above the braid; and a tubular shield sleeve (male shield sleeve 115, female shield sleeve 77, 77A) having a tubular braid covered portion (93) that is inserted between the insulator and the braid and having a fitting portion (91) that extends from the braid covered portion and is inserted between the outer periphery of the inner housing and an inner periphery of the shield body to cover a gap (131) between the braid crimping piece and the shield body.

[2] The high-frequency connector (male high-frequency connector 21, female high-frequency connectors 23, 23A) according to the above [1], in which a hole (119) caused by cutting and raising a standing piece (89) is formed in a rear portion of the shield body (male shield body 113, female shield body 75) on a core wire lead-out side, and the fitting portion (91) blocks the hole.

[3] The high-frequency connector (male high-frequency connector 21, female high-frequency connectors 23, 23A) according to the above [2], in which the hole (119) is closed by a peripheral connecting portion (121) at a further rear of the hole extending in a circumferential direction of the shield body (male shield body 113, female shield body 75), and the peripheral connecting portion contacts and is electrically connected to an outer periphery of the fitting portion (91).

[4] The high-frequency connector (male high-frequency connector 21, female high-frequency connectors 23, 23A) according to the above [1], in which a large diameter portion (103) is formed on the outer periphery of the inner housing (male inner housing 43, female inner housing 61) in a middle in a direction along an axial line, the large diameter portion has an inclined contact portion 123) at a front and a vertical pressed portion (125) at a rear, the shield body (male shield body 113, female shield body 75) is formed with an enlarged diameter portion (83) into which the large diameter portion is fitted so that a boundary with a front portion serves as a contact receiving portion (127), and in the inner housing inserted into the enlarged diameter portion of the shield body, the contact portion contacts the contact receiving portion, and the pressed portion is pressed by a pressing portion (129) formed in the fitting portion (91) of the shield sleeve (male shield sleeve 115, female shield sleeve 77, 77A).

[5] The high-frequency connector (female high-frequency connectors 23A) according to the above [1], in which the shield sleeve (female shield sleeve 77A) is bent in an L shape.

According to the high-frequency connector having a configuration of the above, the inner terminal connected to the end of the cable is accommodated in the inner terminal accommodating chamber of the inner housing. The outer periphery of the inner housing is covered with the tubular shield body. In the cable, an outer periphery of the core wire to which the inner terminal is connected is covered with the insulator, and further, the outer periphery of the insulator is covered with the braid.

In the cable, the braid is crimped by the braid crimping piece of the female crimping member. The braid covered portion of the shield sleeve formed in the tubular shape is inserted between the braid and the insulator in the cable. That is, the braid is sandwiched between the braid covered portion and the braid crimping piece, and is crimped to the braid covered portion.

In the shield sleeve having the braid covered portion, a side opposite to the braid covered portion, as the fitting portion, is inserted between the inner housing and the shield body. Accordingly, the shield sleeve fills the peripheral gap formed between the rear edge of the shield body and the front edge of the braid crimping piece (connected in the peripheral shape).

Therefore, according to the high-frequency connector of the present configuration, when the return current flows through the shield body and the braid crimping piece forming the shield circuit as in the structure in the related art, the return current does not flow being displaced (concentrated) to the connecting portion existing only on the lower side. That is, according to the high-frequency connector of the present configuration, the reduction in the transmission performance between the cable and the shield body can be prevented by eliminating the bias of the current in the axial direction.

In addition, according to the high-frequency connector of the present configuration, by filling the gap occurred between the shield body and the crimping member by the fitting portion of the shield sleeve, it is also possible to prevent, noise from entering and exiting from the gap, thereby preventing the reduction in the noise shielding performance.

As a result, according to the high-frequency connector of the present configuration, it is possible to improve the communication performance in the communication circuit by preventing the reduction in the transmission performance and the reduction in the noise shielding performance.

In the high-frequency connector according to the embodiment, a hole caused by cutting and raising a standing piece is formed in a rear portion of the shield body on a core wire lead-out side, and the fitting portion blocks the hole.

According to the high-frequency connector having a configuration of the above, the fitting portion of the shield sleeve is inserted into the rear portion of the shield body. In the state in which the shield body and the shield sleeve are integrated, the fitting portion of the shield sleeve blocks the hole formed in the shield body caused by cutting and raising the standing piece. The standing piece can form the stabilizer that regulates a direction of rotation around the core wire in the shield body, for example, when the shield body is mounted on the outer housing.

Therefore, according to the high-frequency connector of the present configuration, it is possible to prevent the noise from entering and exiting from the hole caused by cutting and raising the standing piece, and it is possible to prevent the reduction in the noise shielding performance due to the standing piece being cut and raised, and it is possible to improve the communication performance in the communication circuit.

In the high-frequency connector according to the embodiment, the hole is closed by a peripheral connecting portion at a further rear of the hole extending in a circumferential direction of the shield body, and the peripheral connecting portion contacts and is electrically connected to an outer periphery of the fitting portion.

According to the high-frequency connector having a configuration of the above, the hole of the shield body caused by cutting and raising the standing piece is closed by the peripheral connecting portion at the rear, and does not become the notch hole opened at the rear end portion side of the shield body. That is, by providing the peripheral connecting portion at the rear end portion of the shield body, when the fitting portion of the female shield sleeve is fitted between the shield body and the inner housing, the peripheral connecting portion is electrically connected (grounded) to the outer periphery of the fitting portion in the circumferential direction. Therefore, according to the high-frequency connector of the present configuration, even though the hole is formed by cutting and raising the standing piece, the peripheral connecting portion at the rear end portion of the shield body and the fitting portion of the shield sleeve contact with each other along the entire circumference in the circumferential direction, so that it is possible to make the resistance in the electrical connection uniform (no potential difference occurs) and improve the electrical connection performance.

In the high-frequency connector according to the embodiment, a large diameter portion is formed on the outer periphery of the inner housing in a middle in a direction along an axial line, the large diameter portion has an inclined contact portion at a front and a vertical pressed portion at a rear, the shield body is formed with an enlarged diameter portion into which the large diameter portion is fitted so that a boundary with a front portion serves as a contact receiving portion, and in the inner housing inserted into the enlarged diameter portion of the shield body, the contact portion contacts the contact receiving portion, and the pressed portion is pressed by a pressing portion formed in the fitting portion of the shield sleeve.

According to the high-frequency connector having a configuration of the above, when the inner housing is inserted into the shield body, the front contact portion formed in the large diameter portion of the inner housing contacts the contact receiving portion inside the enlarged diameter portion of the shield body, and further insertion is regulated. When the fitting portion of the shield sleeve is fitted into the shield body from the rear portion into which the inner housing is inserted, the pressing portion, which is the tip end of the fitting portion in the fitting direction, presses the pressed portion formed at the rear of the large diameter portion of the inner housing in the fitting direction. In this state, the shield sleeve is integrally fixed to the shield body by press fitting or the like.

That is, the contact portion and the contact receiving portion contact with each other, the pressing portion and the pressed portion contact with each other, and the shield body and the shield sleeve are integrated, so that the inner housing is accommodated in the shield body and the shield sleeve without rattling.

Accordingly, the high-frequency connector of the present configuration is fitted to the mating connector, and in the state where the high-frequency connector is mounted on the vehicle, rattling of the inner housing is prevented even if vibration is applied when the vehicle is running. As a result, in a connection structure between the inner terminal and a mating terminal, the slight sliding wear between the terminals can be prevented, and the reduction in the electrical connection reliability can be prevented.

In the high-frequency connector according to the embodiment, the shield sleeve is bent in an L shape.

According to the high-frequency connector having a configuration of the above, the shield sleeve is bent in the L shape, so that the shield body and the crimping member to which the end of the cable is connected are orthogonal to each other. Therefore, the pull-out direction of the cable can be regulated in the direction orthogonal to the shield body.

Accordingly, it is possible to easily form the high-frequency connector in which the shield assembly is mounted on the outer housing formed in the substantially L shape. As a result, it is not necessary to use the outer conductor terminal (external terminal) that is difficult to form and is bent into the substantially L shape while continuously maintaining the complete tubular shape over the entire length.

According to the high-frequency connector of the present configuration, it is possible to improve the communication performance by preventing the reduction in the noise shielding performance and the reduction in the transmission performance.

What is claimed is:

1. A high-frequency connector comprising:

an inner terminal connected to a core wire of a cable in which an outer periphery of an insulator covering the core wire is covered with a braid;

an inner housing accommodating the inner terminal in an inner terminal accommodating chamber;

a tubular shield body covering an outer periphery of the inner housing;

a crimping member having a braid crimping piece that is crimped from above the braid and a sheath crimping piece; and a tubular shield sleeve having a tubular braid covered portion that is inserted between the insulator and the braid and having a fitting portion that extends from the braid covered portion and is inserted between the outer periphery of the inner housing and an inner periphery of the shield body to cover a peripheral gap between the braid crimping piece and the shield body, wherein the crimping member is a separate piece from the shield body, and the crimping member is arranged in a rear of the shield body such that the peripheral gap is formed between a rear edge of the shield body and a front edge of the braid crimping piece being a front edge of the crimping member.

2. The high-frequency connector according to claim 1, wherein a hole caused by cutting and raising a standing piece is formed in a rear portion of the shield body on a core wire lead-out side, and the fitting portion blocks the hole.

3. The high-frequency connector according to claim 2, wherein the hole is closed by a peripheral connecting portion further rear of the hole extending in a circumferential direction of the shield body, and the peripheral connecting portion contacts and is electrically connected to an outer periphery of the fitting portion.

4. The high-frequency connector according to claim 1, wherein a large diameter portion is formed on the outer periphery of the inner housing in a middle in a direction along an axial line, the large diameter portion has an inclined contact portion at a front and a vertical pressed portion at a rear, the shield body is formed with an enlarged diameter portion into which the large diameter portion is fitted so that a boundary with a front portion serves as a contact receiving portion, and in the inner housing inserted into the enlarged diameter portion of the shield body, the contact portion contacts the contact receiving portion, and the pressed portion is pressed by a pressing portion formed in the fitting portion of the shield sleeve.

5. The high-frequency connector according to claim 1, wherein the shield sleeve is bent in an L shape.

6. The high-frequency connector according to claim 1, wherein the crimping member is axially spaced from the shield body.

* * * * *